US007892608B2

(12) United States Patent
Craamer

(10) Patent No.: US 7,892,608 B2
(45) Date of Patent: Feb. 22, 2011

(54) METHOD AND DEVICE FOR DIGITALLY COATING TEXTILE

(75) Inventor: Johannes Antonius Craamer, Ijlst (NL)

(73) Assignee: Ten Cate Advanced Textiles B.V., Nijverdal (NL)

( * ) Notice: Subject to any disclaimer, the term of this patent is extended or adjusted under 35 U.S.C. 154(b) by 852 days.

(21) Appl. No.: 10/571,896

(22) PCT Filed: Sep. 22, 2004

(86) PCT No.: PCT/EP2004/010731

§ 371 (c)(1),
(2), (4) Date: Mar. 14, 2006

(87) PCT Pub. No.: WO2005/028729

PCT Pub. Date: Mar. 31, 2005

(65) Prior Publication Data

US 2007/0026213 A1 Feb. 1, 2007

(30) Foreign Application Priority Data

Sep. 22, 2003 (NL) ..... 1024338
Nov. 28, 2003 (NL) ..... PCT/NL03/00841

(51) Int. Cl.
*B05D 5/00* (2006.01)
*B05B 7/00* (2006.01)

(52) U.S. Cl. ..... 427/427.2; 427/424; 118/300; 8/445

(58) Field of Classification Search ..... 427/424, 427/427.2; 118/300; 8/445
See application file for complete search history.

(56) References Cited

U.S. PATENT DOCUMENTS

| | | | | |
|---|---|---|---|---|
| 3,717,722 | A | 2/1973 | Messner | |
| 4,580,304 | A | 4/1986 | Otting | |
| 4,650,694 | A | 3/1987 | Dressler et al. | |
| 4,702,742 | A | 10/1987 | Iwata et al. | |
| 4,791,434 | A | 12/1988 | Wills | |
| 5,416,612 | A * | 5/1995 | Ingraham et al. | 358/501 |
| 5,818,486 | A | 10/1998 | Koike et al. | |
| 6,156,072 | A * | 12/2000 | Usui et al. | 8/115.6 |
| 2001/0046826 | A1 | 11/2001 | Tebbe | |
| 2003/0081094 | A1 | 5/2003 | Van Veen et al. | |
| 2003/0117471 | A1 | 6/2003 | Sharma | |

FOREIGN PATENT DOCUMENTS

DE 19930866 2/2000

(Continued)

*Primary Examiner*—Lynda Salvatore
(74) *Attorney, Agent, or Firm*—Hoyng Monegier LLP; Coraline J. Haitjema; David P. Owen

(57) ABSTRACT

A method is disclosed for digitally forming a coating on a fibrous textile having mesh openings between adjacent fibers. According to the method, textile is fed continuously along a treatment path having a row of static coating nozzles arranged generally transversely across the path. The coating nozzles have outlet diameters of greater than about 70 microns and are supplied with a supply of a coating substance. By individually controlling the nozzles, a substantially continuous stream of droplets of the coating substance is produced and selectively directed onto the textile to form a coating of pixels. Each pixel covers at least four mesh openings and has a diameter of more than 100 microns.

24 Claims, 4 Drawing Sheets

FOREIGN PATENT DOCUMENTS

| | | | |
|---|---|---|---|
| EP | 1048466 | | 11/2000 |
| GB | 2187419 | | 9/1987 |
| JP | 61-146831 | | 7/1986 |
| JP | 61-152874 | | 7/1986 |
| JP | 63-85156 | | 4/1988 |
| JP | 50-51876 | | 3/1993 |
| JP | 5-209379 | A | 8/1993 |
| JP | 06-305131 | A | 11/1994 |
| JP | 09-194776 | A | 7/1997 |
| JP | 10-140451 | | 5/1998 |
| JP | 2000-085140 | A | 3/2000 |
| WO | WO02/064877 | | 8/2002 |

* cited by examiner

METHOD AND DEVICE FOR DIGITALLY COATING TEXTILE

CROSS REFERENCE TO RELATED APPLICATIONS

The present application claims priority from Dutch application number 1024335 filed on 22 Sep. 2003 and also from PCT application No PCT/NL03/00841 filed on 28 Nov. 2003, the contents of which are hereby incorporated by reference in their entirety.

BACKGROUND OF THE INVENTION

1. Field of the Invention

The present invention relates to a device for digitally coating textile. In particular, it relates to a device for coating a textile using a continuous flow inkjet technique to provide accurate coating characteristics. It furthermore relates to a method of coating textiles using such a technique and to the textile produced thereby.

2. Description of the Related Art

Coating is one of the operations frequently performed during the production of textiles. Roughly five stages can be distinguished in such production; the fibre production; spinning of the fibres; the manufacture of cloth (for instance woven or knitted fabrics, tufted material or felt and non-woven materials); the upgrading of the cloth; and the production or manufacture of end products. Textile upgrading covers a number of operations such as preparing, bleaching, optically whitening, colouring (painting and/or printing), coating and finishing. These operations generally have the purpose of giving the textile the appearance and physical characteristics that are desired by the user. Coating of the textile is one of the more important techniques of upgrading and may be used to impart various specific characteristics to the resulting product. It may be used for making the substrate fireproof or flameproof, water-repellent and/or oil repellent, non-creasing, shrink-proof, rot-proof, non-sliding, fold-retaining and/or antistatic.

Conventional processes for upgrading textile are composed of (FIG. 1) a number of part-processes or upgrading steps, i.e. pre-treating the textile article (also referred to as the substrate), painting the substrate, coating the substrate, finishing the substrate and the post-treatment of the substrate. The usual techniques for applying a coating on solvent or water basis are the so-called knife-over-roller, the dip and the reverse roller coaters. A dispersion of a polymer substance in water is usually applied to the cloth and excess coating is then scraped off with a doctor knife. Certain characteristics are difficult to achieve using such conventional coating techniques and must be attained by other techniques. In order to provide a full colour to the article, painting may take place by immersing the textile article in a paint bath, whereby the textile is provided on both sides with a coloured substance. For other effects, foularding (impregnating and pressing) may be used.

Each of the upgrading steps shown in FIG. 1 consists of a number of operations. Different treatments with different types of chemicals are required, depending on the nature of the substrate and desired end result. For the upgrading steps of printing, painting, coating and finishing four recurring steps can generally be distinguished which often take place in the same sequence. These treatments are referred to in the professional field as unit operations. These are the treatments of impregnation (i.e. application or introduction of chemicals), reaction/fixing (i.e. binding chemicals to the substrate), washing (i.e. removing excess chemicals and auxiliary chemicals) and drying. These unit operations may also need to be repeated a number of times for each upgrading step e.g. repeated washing cycles. Large quantities of chemical reagents and water are generally used which entails a relatively high environmental impact, a long throughput time and relatively high production costs.

It is moreover usual at present to carry out the different upgrading steps of the textile in separate devices. This means that for instance the painting is performed in a number of paint baths specially suited for the purpose, the printing and coating are carried out in separate printing devices and coating machines, while finishing is carried out by yet another device. Because the different operations are carried out individually in separate devices, the treating of the textile requires a relatively large area, usually spread over different room areas.

It is thus desirable to provide methods of upgrading, i.e. painting, coating and finishing, a substrate of textile where the above stated drawbacks and other drawbacks associated with conventional processes are reduced.

Various attempts have been made to use inkjet printing techniques for performing upgrading steps. In particular, inkjet printers have been suggested for printing an image onto a textile. Conventional inkjet techniques known for printing onto paper media have however been found difficult to implement for textile production where textile widths of more than 1 meter are standard and production speeds of 20 meters per minute or more are required in order for the process to be efficient. In particular, conventional inkjet printers comprise a printing head that moves backwards and forwards across the medium. The printing head has a number of nozzles through which streams of ink droplets may be fired. These print heads operate according to the dot-on-demand principle i.e. they are electronically controlled to deposit an ink droplet or not according to the image to be printed. The medium is fed forwards intermittently after each pass of the printing head. Both the intermittent feed and the drop-on-demand control cause the process to be too slow for practical use. Feed velocities of 2 meters per minute are currently achievable using such methods for textile printing. A process is known from U.S. Pat. No. 4,702,742 in which a conventional printing device is used to print onto white cloth sheets. A further process is suggested in German patent application No. DE 199 30 866 in which both ink and a fixing solution are applied to a textile using a conventional inkjet head.

In particular, it has been found that conventional inkjet printing devices are unsuitable for the purpose of coating textiles. This is particularly the case when used on fibrous textiles in which gaps exists between the adjacent fibres, especially for coarsely woven or knitted textiles. Typical nozzle diameters used in conventional inkjet devices are relatively small in order to provide fine pixel definition. It has been found that the droplets produced by such nozzles tend to pass into or even through the gaps providing a less than adequate surface finish. It has also been found that despite the advantages of printing onto textile using inkjet techniques, pixel definition of images produced on coarse textiles is often deficient due to the coarseness of the fibre structure and other effects such as wicking which may not be homogenous in all directions.

BRIEF SUMMARY OF THE INVENTION

According to the invention there is provided a method of digitally forming a coating on a fibrous textile having mesh openings between adjacent fibres, wherein the method comprises continuously feeding the textile along a treatment path having a row of static coating nozzles arranged generally transversely across the path, the coating nozzles having outlet diameters of greater than about 70 microns, supplying the nozzles with a supply of a coating substance, individually controlling the nozzles to provide a substantially continuous stream of droplets of the coating substance and selectively directing the individual droplets to impinge on the textile to form a coating of pixels lying generally on the surface of the textile, each pixel covering at least four mesh openings and having a diameter of more than 100 microns. In this way, by using a larger nozzle and producing a droplet of sufficient size to cover four mesh openings, the droplet is adequately supported and spread or flattened across the textile surface. In the present context, the pixel formed by the droplet is considered to lie generally on the surface but may also enter the gaps between the fibres and may also partially surround the fibre at least on the side of the one surface in order to form an adequate bond therewith. The method is particularly applicable to woven or knitted textiles.

Preferably, the method further comprises feeding the textile along a second row of static nozzles also arranged generally transversely across the path, supplying the second row of nozzles with a supply of a second substance and individually controlling the nozzles to provide a substantially continuous stream of droplets of the second substance to the textile. The second row of nozzles may be used for another distinct upgrading step. In particular they may be used for printing, painting or dying the fabric. In particular, the second row may comprise nozzles having outlet diameters of less than 50 microns to produce a finer pixel definition. In an exemplary embodiment, high definition inkjet printing may be performed onto the coating after the textile has passed the first row of nozzles. Alternatively, the second substance may be applied prior to the coating substance. In this case, it may e.g. be received and absorbed within the fibrous structure and the coating may form a protective layer thereover.

In another embodiment of the invention, the second row of nozzles may be provided on the opposite side of the treatment path from the first row of nozzles. In this case, the second row may be substantially similar to the first row and the method may comprise applying the coating on both surfaces of the textile. Alternatively, the second row may be used to apply a different substance to the second surface of the textile whereby the finished textile exhibits different characteristics on each surface. Further rows of nozzles may be provided according to the treatments required.

It has been found extremely advantageous to use nozzles of the continuous inkjet multi-level deflection type. The method may thus comprise electrically charging or discharging the droplets, applying an electric field, and varying the electric field so as to deflect droplets such that they are individual deposited at suitable positions on the textile. In this way the precise position of each pixel may be carefully controlled e.g. the degree of overlap or the spacing therebetween. Using such techniques, each nozzle may generate as many as 100,000 droplets per second. In the case of a plurality of rows of nozzles, some rows may be of the multi-level deflection type while other rows may be of the binary level type.

Preferably, the nozzles are arranged over substantially a full width of the treatment path and the coating is applied substantially over a full width of the textile. This width may be in excess of 1 meter, however it is common to produce textiles having widths of up to 2.5 meters.

In a preferred embodiment, the coating is a water-repellent coating and the coating substance may comprises a fluorocarbon or silicon based emulsion, an anti-foaming medium, an electrolyte and a thickener. By applying such a coating in an open structure with pores between adjacent pixels, a breathable structure may be achieved.

Preferably, the coating substance has a viscosity of greater than 4 centipoise as measured with a Brookfield viscosimeter. It has been found that use of a such viscosities with nozzle diameters of 70 microns or more ensures that droplets are formed having adequate form stability on impact with the textile, whereby the desired form of pixel is achieved. Lower viscosities may lead to greater wicking of the coating substance along and around the fibre structure.

According to an important feature of the present invention, the treatment path may comprise a conveyor and the textile may be affixed to the conveyor, whereby the position of the textile relative to the conveyor may be maintained. In this way, when the precise location of each pixel is important, shifting of the textile may be prevented. This is particularly important when the treatment includes printing using different colours applied by different rows of nozzles. The textile may be affixed to the conveyor by means of adhesive or the like.

The present invention also relates to a device for digitally coating a textile, the device comprising a conveyor for substantially continuously feeding the textile along a treatment path, a row of static coating nozzles arranged generally transversely across the path, for applying a coating substance over substantially the complete width of the textile, wherein the coating nozzles have outlet diameters of greater than 70 microns and are individually controlled to provide a substantially continuous stream of droplets that can be selectively directed to impinge on the textile. In the present context, static is intended to denote that the nozzles do physically move across the treatment path from one side to the other. Furthermore, the term continuous is intended to denote that the stream of droplets is continuous during operation of the device whereby those droplets that are not required are diverted to a collection device. Such a definition is considered to be clearly distinguish over so-called drop-on-demand systems.

According to an advantageous embodiment, the device may additionally comprise a second or further rows of nozzles arranged generally transversely across the path, for applying a further substance to the textile. For performing a different finishing step such as dying or printing, the second row of nozzles may have outlet diameters of less than 70 microns, preferably about 50 microns. They are preferably also individually controlled to provide a substantially continuous flow of droplets that can be selectively directed to impinge on the textile.

According to a particular embodiment of the device, rows of nozzles may be arranged on both sides of the path for coating or otherwise applying substances to both surfaces of the textile.

In order to adequately and accurately perform the operation across the full width of the textile, each row of nozzles is provide on a printing beam spanning the treatment path. Preferably, each beam comprises a plurality of heads, each head comprising a number of nozzles. By using separate heads, the pressure distribution between individual nozzles may be carefully controlled. In particular, using around eight nozzles per head, adequate pressure control to each nozzle is ensured. In such case, a total of between 10 and 100 heads may be provided on each beam.

According to a preferred embodiment, the nozzles are of the multi-level deflection ink-jet type, whereby the position of a droplet on the textile may be controlled. Alternatively, some or all of the rows of nozzles may be of the binary deflection ink-jet type, whereby a droplet exiting the nozzle can be selectively directed onto the textile or into a collector. Whichever type of nozzle is used, it is desirable that they can be controlled to each generate at least 100,000 droplets per second in order to achieve the required process speed.

Preferably, the conveyor is wide enough to accommodate textiles of more than 1 meter in width, more preferably up to about 2 meters in width. It should also be arranged to operate at a speed of more than 15 meters per minute, more preferably at more than 25 meters per minute. It may also be provided with adhesive or the like for preventing relative movement of the textile.

The present invention further relates to a digitally coated fibrous textile having mesh openings between adjacent fibres, the fibres having an average spacing of greater than 40 microns, the textile being provided with a coating comprising a plurality of pixels of coating material lying substantially on the surface of the textile, each pixel covering at least four mesh openings and having a diameter of more than 100 microns. Preferably, the textile is a woven or knitted textile.

According to further particular embodiments of the invention, the textile may have a width of greater than 1.5 meters. Furthermore, the coating may be provided in the form of a closed coating with overlapping pixels or in the form of an open coating with pores between adjacent pixels.

BRIEF DESCRIPTION OF THE DRAWINGS

The invention will now be described in further detail with reference to a number of exemplary embodiments according to the annexed figures, in which.

DESCRIPTION OF ILLUSTRATIVE EMBODIMENTS

Figure 1:
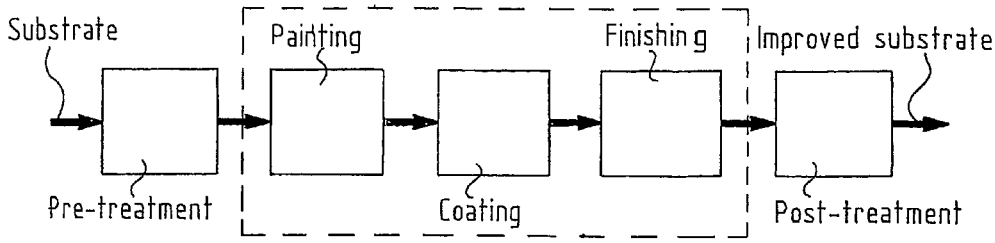
FIG. 1 shows a schematic block diagram of the process of upgrading a substrate.
Figure 2:
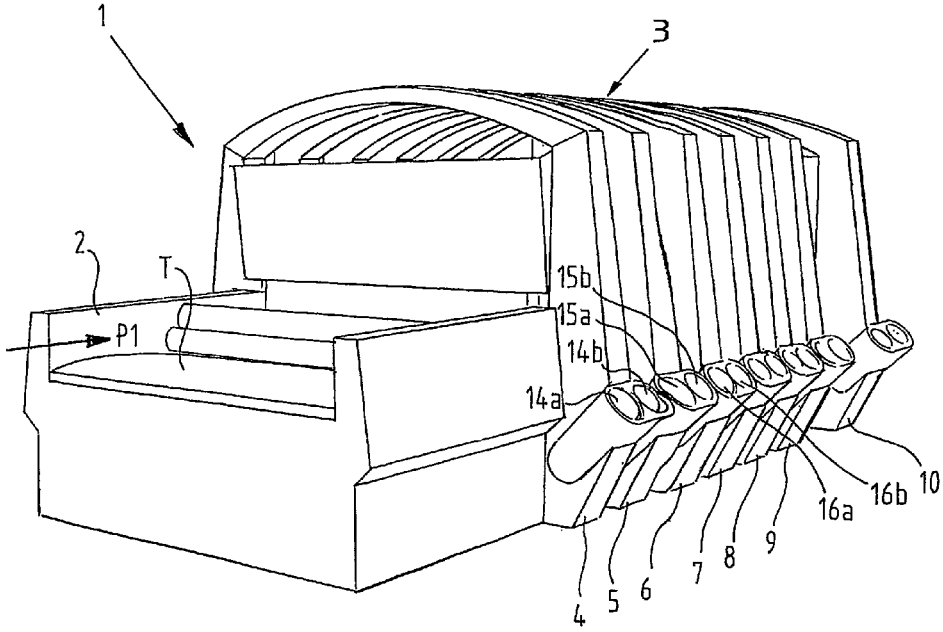
FIG. 2 shows a view in perspective of a textile upgrader including a coating device according to the present invention.
Figure 3:
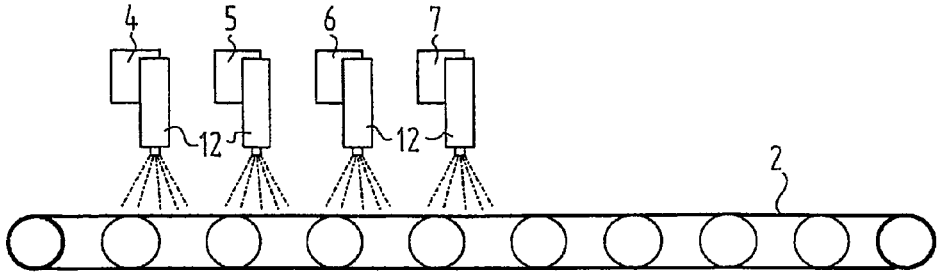
FIG. 3 is a schematic side view of the textile upgrader of FIG. 2.
Figure 4:
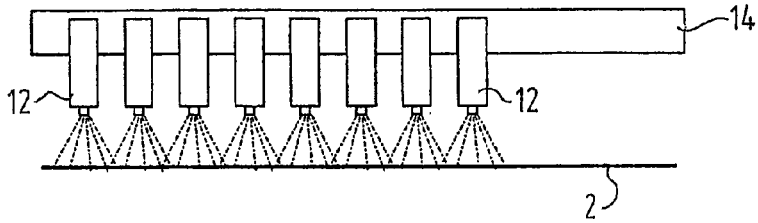
FIG. 4 is a schematic front view of the textile upgrader of FIG. 2.

FIGS. 2-5 show a textile upgrader 1 according to a preferred embodiment of the invention. Textile upgrader 1 is built up of an endless conveyor belt 2 driven using electric motors (not shown). On conveyor belt 2 can be arranged a textile article T which can be transported in the direction of arrow $P_1$ along a housing 3 in which the textile undergoes a number of operations. The textile is physically affixed to the conveyor by means of an adhesive to prevent shifting of the textile during the process. Finally, the textile is discharged in the direction of arrow $P_2$ by release of the adhesive. A large number of nozzles 12 are arranged in housing 3. The nozzles are arranged on successively placed parallel beams 14. A first row 4, a second row 5, a third row 6 and so on are thus formed. The number of rows may vary (indicated in FIG. 5 with a dotted line) and depends on e.g. the desired number and nature of the operations. The number of nozzles per row is also variable and depends among other things on the desired resolution of the designs to be applied to the textile. In the illustrated embodiment, the effective width of the beams is about 1 m, and the beams are provided with about 29 fixedly disposed spray heads, each having about eight nozzles per head. Each of the nozzles 12 generates a stream of droplets of substance.

In the preferred continuous inkjet method, pumps carry a constant flow of ink or other medium through one or more very small holes of the nozzles. In the following, although reference will be made to ink and inkjet, this is understood not to be limiting and that other substances may also be ejected from the nozzles. One or more jets of ink, inkjets, are ejected through these holes. Under the influence of an excitation mechanism such an inkjet breaks up into a constant flow of droplets of the same size. The most used excitator is a piezo-crystal although other forms of excitation or cavitation may be used. From the constant flow of droplets of the same size which are now generated must be selected those droplets which are to be applied to the substrate of the textile and those which should not be applied. For this purpose the droplets are electrically charged or discharged. There are two variations for arranging droplets on the textile. According to the one method an applied electric field deflects the charged droplets, wherein the charged droplets come to lie on the substrate. This method is also referred to as binary deflection. According to another preferred method, also known as the multi-level method, the electrically charged droplets are usually directed to the textile and the uncharged droplets are deflected. The droplets are herein subjected to an electric field which is varied between a plurality of levels such that the final position at which the different droplets come to lie on the substrate can hereby be adjusted.

Figure 5:
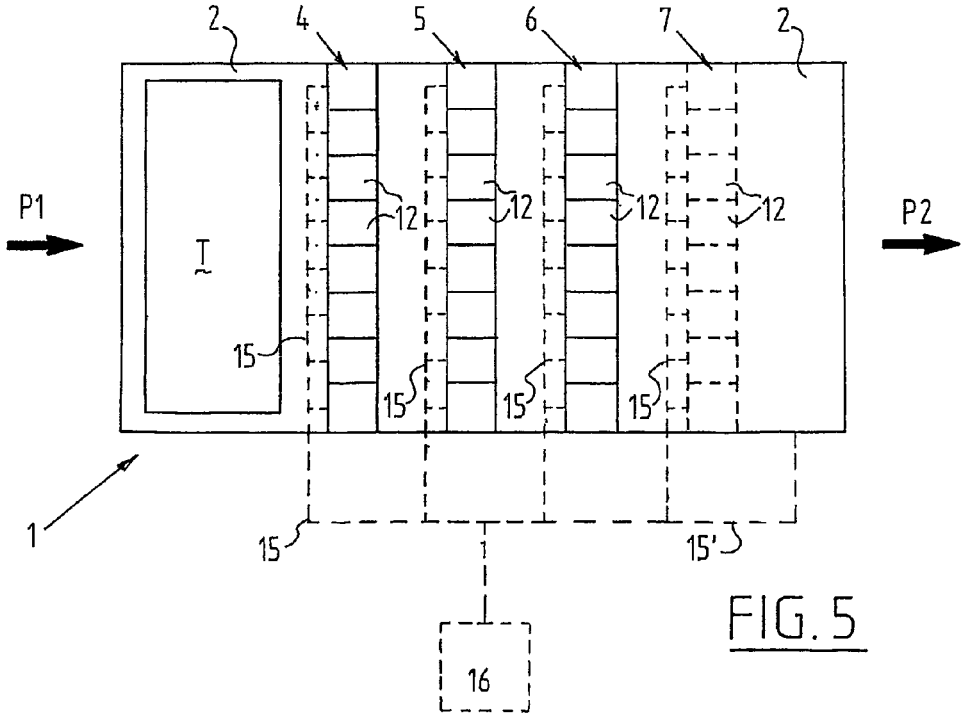
FIG. 5 is a cut-away schematic view of the textile upgrader of FIG. 2.

In FIG. 5 is indicated with dotted lines that the different nozzles 12 are connected electrically or wirelessly) by means of a network 15 to a central control unit 16, which comprises for instance a microcontroller or a computer. The drive of the conveyor belt 2 is also connected to the control unit via network 15'. The control unit can now actuate the drive and the individual nozzles as required.

Also arranged per row of nozzles 4-11 is a double reservoir in which the substance to be applied is stored. The first row of nozzles 4 is provided with reservoirs 14*a*,14*b*, the second row 5 is provided with reservoirs 15*a*,15*b*, the third row 6 is provided with reservoirs 16*a*,16*b* and so on. The appropriate substance is arranged in at least one of the two reservoirs of a row.

Figure 6:
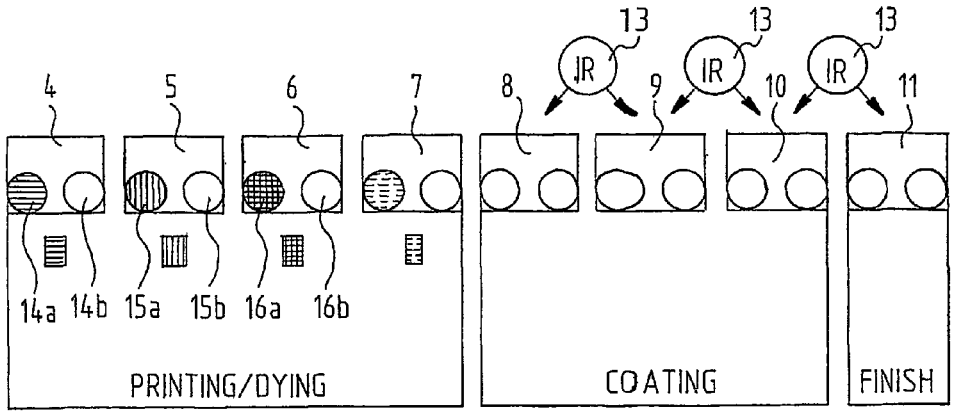
FIG. 6 is a schematic representation of a preferred sequence for performing the different treatment steps.

The different reservoirs are filled with appropriate substances and the nozzles 12 disposed in different rows are directed such that the textile article undergoes the correct treatment. In the situation shown in FIG. 6, reservoir 14*a* of the first row 4 contains cyan-coloured ink, reservoir 15*a* of the second row 5 contains magenta-coloured ink, reservoir 16*a* of the third row 6 contains yellow-coloured ink and reservoir 17*a* of the fourth row 7 contains black coloured ink. The textile article is provided in rows 4-7 with patterns in a painting/printing treatment. The nozzles in these rows have outlet diameters of about 50 microns. The reservoirs of the three subsequent rows 8-10 contain one or more substances with which the treated textile can be coated in three passages for the purpose of coating the textile, the nozzles in rows 8-10 have outlet diameters of 70 microns. The eighth reservoir 11 contains a substance with which the printed and coated textile can be finished. In this embodiment the textile article T is preferably treated at the position of the fifth to the eighth row with infrared radiation coming from light sources 13 in order to influence the coating of the finishing.

Figure 7:
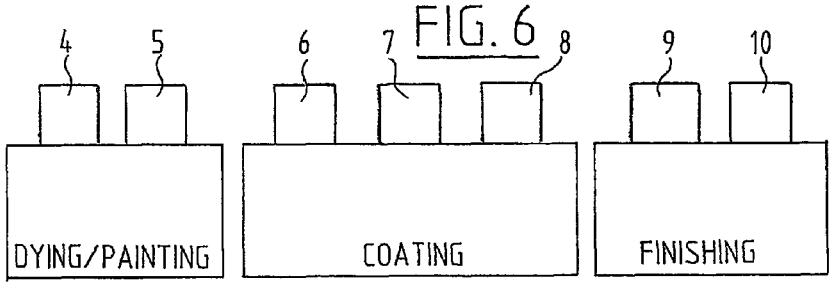
FIG. 7 is a schematic representation of an alternative preferred sequence for performing the upgrading steps.

FIG. 7 shows another situation in which the textile undergoes another treatment sequence. The textile article T is first of all painted by guiding the textile along the first row 4 and second row 5 of nozzles. These rows 4, 5 have nozzles of 70 microns and apply a relatively smooth coloured coating onto the textile. In the third to fifth rows 6-8 the painted textile is then coated as above, whereafter the finishing step is carried out in the sixth and seventh rows 9,10.

Figure 8:
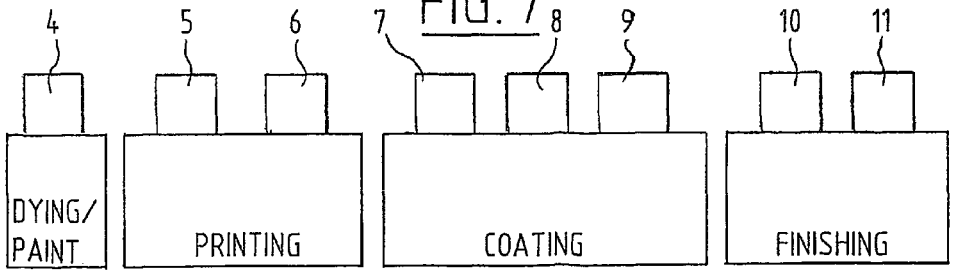
FIG. 8 is a schematic representation of a further preferred sequence for performing the upgrading steps.

In the embodiment shown in FIG. 8, the textile article is first of all guided along the first row 4 of nozzles. The nozzles in row 4 are of about 70 microns and provide a smooth full background colour to the textile over the full width. The textile article is subsequently guided along the second row 5 and third row 6 by means of the conveyor belt, wherein patterns are printed onto the prepared surface. Good definition can be achieved in the printing steps at rows 5 and 6 using fine nozzles of between 30 and 50 microns. The textile is then guided along the fourth to sixth rows 7-9 to coat the painted and printed textile in three passages, whereafter a final finishing treatment step is performed in the seventh and eighth rows 10, 11.

It is possible to treat different successively transported textile articles in different ways, in some cases even without the transport of the textile therein having to be interrupted. It is for instance possible by means of computer control of nozzles 12 to provide successively supplied textile articles with designs which differ in each case. It is also possible to have different substances applied to the textile through an appropriate choice of the reservoirs. The first reservoirs 14*a*, 15*a*, 16*a* are for instance used in each case for a first type of textile, while the second reservoirs 14*b*, 15*b*, 16*b* are used for another type of textile.

In order to determine the environmental advantages of the present invention, use can be made of an example of a representative upgrading process in which a substrate passes through four cycles of unit operations for the purpose of painting, followed by four cycles for the coating and finally two cycles for the finishing. The quantification is based on the production of a 1,800 meter long and about 1.6 meter wide substrate of bleached and dried cotton with a weight of 100 grams per square meter of substrate. The painting, coating and finishing are herein each performed in one process run, with the necessary post-treatments and/or pre-treatments between these process runs. If the treatments can be carried out in one process run, the environmental advantages will therefore be even greater.

In the traditional upgrading process, practically every component (painting, coating and finishing) takes place in and/or with a highly aqueous solution. In the digital process according to the invention a highly concentrated solution is sprayed directly onto the substrate with a precisely controlled dosage. Less water is hereby used. For the purpose of rinsing/washing out excess chemicals and auxiliary chemicals, practically every cycle of unit operations comprises a rinsing step. The number of rinsing steps can be reduced from ten in the existing process (four times painting, four times coating and twice finishing) to three in the present digital process (i.e. once painting, once coating and once finishing). Seven fewer rinsing steps are therefore needed. This means that a considerable reduction in the water consumption can already be realized by curtailing the rinsing. The total reduction in the water consumption is in many cases more than 90%.

The energy consumption can also be reduced considerably, since among other things forced drying is not necessary, or is only necessary to a very limited extent, rinsing with hot/warm rinsing water is not necessary, or only to a very limited extent, and the mechanical handling of the substrate is very greatly reduced.

In the known upgrading process drying usually takes place between the different unit operations, and also within operations when a cycle has to be carried out a number of times. The substrate can contain up to several times its own weight of water. Drying generally takes place in two phases. In the first phase the greater part of the water is removed from the substrate mechanically. In the second phase there follows thermal drying, wherein the remaining water present in the substrate is evaporated.

Because the present digital upgrading process is performed almost without water, no water, or practically no water, has to be evaporated, such as for instance by drying, between the different upgrading steps and after the final upgrading step. A very considerable energy-saving is hereby realized. The limited drying which is necessary in some cases can be realized in most cases by means of directional UV driers. In general as little as 70% water by weight may be required for the coating substance.

In digital processes, because of the very limited washing of the substrate required it will also be possible to considerably reduce the number of mechanical operations, including transport of the substrate between the different upgrading operations, compared to the known upgrading process. The electrical energy consumption will hereby also decrease considerably. In total, a reduction in the energy consumption by more than 90% may be realized.

With current production techniques about 150 grams of wet substances (chemicals) are applied per square meter. In digital printing, owing to more precise dispensing, lower pressure and less absorption in the textile, the quantity of chemical substances to be applied can be reduced to about 50 grams of wet substance per square meter. It is hereby possible to make a saving of about 66% in the chemicals. The saving relates not only to the primary chemicals but also to the additives, such as salts, with which the substrate is pre-treated in the digital process in order to facilitate the action, fixation and/or reactivity of the primary chemicals. It is expected that a saving of 66% can also be made on these additives. Finally, the waste water production and the contamination impact of the waste water can be reduced by more than 90%.

Figure 9:
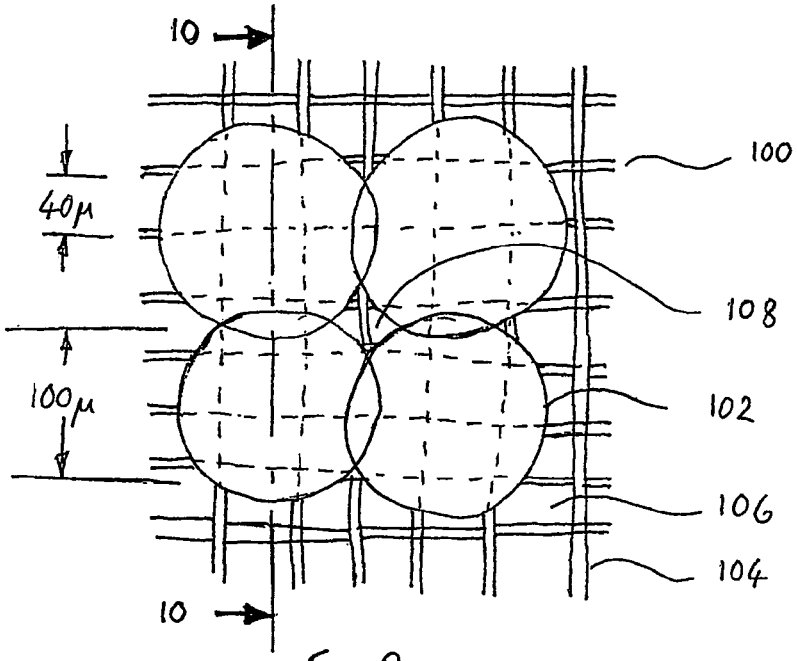
FIG. 9 shows a schematic view of a portion of woven textile coated according to the invention.

FIG. 9 shows a schematic view of a portion of woven textile 100 on which four pixels 102 of a coating material have been deposited. The textile 100 comprises fibres 104 arranged in a mesh with mesh openings 106 between the fibres 104. The fibre spacing is approximately 40 microns and the pixels 102 each have a diameter of approximately 100 microns. As can be seen from FIG. 9, each pixel 102 effectively covers at least four complete openings 106. Additionally, it can be seen that the pixels 102 do not form a completely closed coating in that a pore 108 is formed between adjacent pixels 102.

Figure 10:
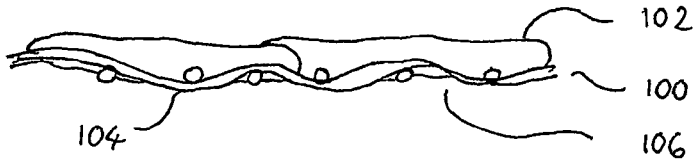
FIG. 10 is a cross section through the textile of FIG. 9 along the line 10-10.

FIG. 10 is a cross section through the textile 100 of FIG. 9 along the line 10-10. It can be seen that the pixels 102 are generally located on the surface of the textile, spanning the openings 106 between adjacent fibres 104. Because of the viscose nature of the coating substance, each pixel 102 partially maintains its shape and although the pixels 102 flow together in the overlap region, the individual pixels are still discernable. It can furthermore be seen that the coating substance forming the pixel 102 partially envelopes the fibres 104 on the coated surface to form a good bond therewith. The viscosity of the coating substance is chosen to ensure the correct degree of impregnation of the material.

Figure 11:
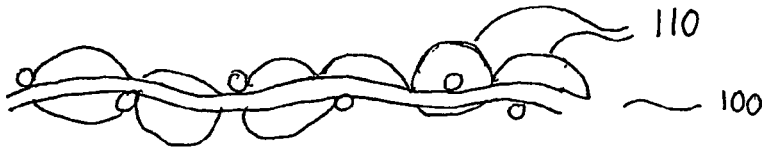
FIG. 11 shows a similar view to FIG. 10 through a coated textile in which smaller droplets have been used.

FIG. 11 shows a similar view to FIG. 10 taken through a textile 100 in which smaller droplets 110 of a coating substance have been applied. The droplets 110 are of a similar size to the mesh opening 106 and tend to pass into and even through the openings. The resultant effect is less homogenous than in the case of FIG. 10 and it is also more difficult to provide a different characteristic to the opposite facing surfaces of the textile.

While FIGS. 9 and 10 illustrate the case of a textile weave of approximately 40 microns, it is also within the scope of the invention that even coarser weaves or structures may be used. Thus, for fibre spacing of 100 microns, a nozzle size of 200 microns could be contemplated.

The invention is not limited to the above described preferred embodiments. In particular, the rights sought are rather defined by the following claims, within the scope of which many modifications can be envisaged.

What is claimed is:

1. A method of digitally forming a coating on a fibrous textile having mesh openings between adjacent fibres, the method comprising:

continuously feeding the textile along a treatment path having a row of coating nozzles arranged across the path, the coating nozzles having outlet diameters of greater than about 70 microns;

supplying the nozzles with a supply of a coating substance;

individually controlling the nozzles to provide a substantially continuous stream of droplets of the coating substance;

selectively directing the individual droplets to impinge on the textile to form a coating of pixels lying generally on an unprinted surface of the textile, each pixel covering at least four mesh openings and having a diameter of more than 100 microns;

feeding the textile along a second row of nozzles also arranged across the path;

supplying the second row, of nozzles with a supply of a second substance; and individually controlling the nozzles to provide a substantially continuous stream of droplets of the second substance to the textile.

2. The method according to claim 1 wherein the second row of nozzles comprises nozzles having outlet diameters not greater than about 50 microns.

3. The method according to claim 1, wherein the second substance is applied prior to the coating substance and is received within the fibrous structure.

4. The method according to claim 1, wherein the second substance is applied after the coating substance and forms individual pixels on the coating.

5. A method of digitally forming a coating on a fibrous textile having mesh openings between adjacent fibres, the method comprising:

continuously feeding the textile along a treatment path having a row of coating nozzles arranged across the path, the coating nozzles having outlet diameters of greater than about 70 microns;

supplying the nozzles with a supply of a coating substance;

individually controlling the nozzles to provide a substantially continuous stream of droplets of the coating substance;

selectively directing the individual droplets to impinge on the textile to form a coating of pixels lying generally on an unprinted surface of the textile, each pixel covering at least four mesh openings and having a diameter of more than 100 microns; wherein the nozzles are of the continuous inkjet multi-level deflection type and the method comprises electrically charging or discharging the droplets, applying an electric field, and varying the electric field or a charge on the droplets so as to deflect droplets such that they are individually deposited at suitable positions on the textile.

6. The method according to claim 5, wherein each nozzle generates at least 100,000 droplets per second.

7. The method according to claim 5, wherein the nozzles are arranged over substantially a full width of the treatment path and the coating is applied substantially over a full width of the textile.

8. The method according to claim 5, wherein nozzles are provided on both sides of the treatment path and the method further comprises applying the coating on both surfaces of the textile.

9. The method according to claim 5, wherein the coating is applied with an open structure comprising spaces between adjacent pixels.

10. The method according to claim 5, wherein the coating is a water-repellent coating.

11. A method of digitally forming a coating on a fibrous textile having mesh openings between adjacent fibres, the method comprising:

continuously feeding the textile along a treatment path having a row of coating nozzles arranged across the path, the coating nozzles having outlet diameters of greater than about 70 microns;

supplying the nozzles with a supply of a coating substance;

individually controlling the nozzles to provide a substantially continuous stream of droplets of the coating substance;

selectively directing the individual droplets to impinge on the textile to form a coating of pixels lying generally on an unprinted surface of the textile, each pixel covering at least four mesh openings and having a diameter of more than 100 microns, wherein the coating substance comprises a fluorocarbon or silicon based emulsion, an anti-foaming medium, an electrolyte and a thickener.

12. The method according to claim 1, wherein the coating substance has a viscosity of greater than 4 centipoise as measured with a Brookfield viscosimeter.

13. The method according to claim 1, wherein the treatment path comprises a conveyor and the textile is affixed to the conveyor to substantially prevent relative movement therebetween.

14. A device for digitally coating a textile, the device comprising:

a conveyor for substantially continuously feeding the textile along a treatment path;

a first row of coating nozzles arranged across the path, for applying a coating substance over substantially the complete width of the textile, wherein the coating nozzles have outlet diameters of greater than 70 microns and are individually controllable to provide a substantially continuous stream of droplets that can be selectively directed to impinge on the textile, the device further comprising a second row of nozzles arranged across the path, for applying a further substance to the textile simultaneously with or subsequent to application of the coating substance, wherein the second row of nozzles have outlet diameters of less than 70 microns and are also individually controllable to provide a substantially continuous flow of droplets that can be selectively directed to impinge on the textile.

15. A device for digitally coating a textile, the device comprising:

a conveyor for substantially continuously feeding the textile along a treatment path;

a first row of coating nozzles arranged across the path, for applying a coating substance over substantially the complete width of the textile, wherein the coating nozzles have outlet diameters of greater than 70 microns and are individually controllable to provide a substantially continuous stream of droplets that can be selectively directed to impinge on the textile, the device further comprising a second row of nozzles arranged across the path, for applying a further substance to the textile simultaneously with or subsequent to application of the coating substance, wherein the first and second rows of nozzles are arranged on both sides of the path for applying substances to both surfaces of the textile.

16. The device of claim 14, wherein the first row of nozzles is provided on a printing beam comprising a plurality of coating heads, each coating head comprising a plurality of nozzles.

17. The device of claim 14 wherein the coating nozzles are of the multi-level deflection ink-jet type, whereby the position of a droplet on the textile may be controlled.

18. The device of claim 14, wherein the nozzles are of the binary deflection ink jet type, whereby a droplet exiting the nozzle may be selectively directed onto the textile or into a collector.

19. The device of claim 14, wherein the nozzles are controlled to each generate at least 100,000 droplets per second.

20. The device of claim 14, wherein the conveyor is arranged to operate at a speed of more than 15 meters per minute.

21. The method according to claim 2, wherein the second substance is applied prior to the coating substance and is received within the fibrous structure.

22. The method according to claim 2, wherein the second substance is applied after the coating substance and forms individual pixels on the coating.

23. The method according to claim 1, wherein the coating nozzles are static coating nozzles arranged in a row generally transversally across the path.

24. The device according to claim 14, wherein the coating nozzles are static coating nozzles arranged in a row generally transversally across the path.

* * * * *